US005781934A

United States Patent [19]

Pauley, Jr.

[11] Patent Number: 5,781,934

[45] Date of Patent: Jul. 21, 1998

[54] SIMULATIVE SPORTS CAP KIT

[76] Inventor: Terrance P. Pauley, Jr., 2909 N. Magellan Dr., McHenry, Ill. 60050

[21] Appl. No.: 833,204

[22] Filed: Apr. 14, 1997

[51] Int. Cl.[6] ..... A42B 1/24

[52] U.S. Cl. ..... 2/209.13; 2/195.1; 2/244; 446/27; D2/872; D2/895

[58] Field of Search ..... 2/244, 209.13, 2/245, 195.1; 446/26, 27; D2/869, 870, 871, 872, 873, 874, 895

[56] References Cited

U.S. PATENT DOCUMENTS

D. 313,497 1/1991 Amozorrutia et al. ..... D2/872

4,611,355 9/1986 Galanto et al. ..... 2/246

4,985,935 1/1991 Hur ..... 2/195.1

*Primary Examiner*—Diana Biefeld

*Attorney, Agent, or Firm*—Kajane McManus

[57] ABSTRACT

The sports cap kit includes a sports cap with a primary symbol representing a favored sports team attached to the cap above a visor thereof. The primary symbol has a normally open mouth including a movable jaw. At least one smaller, removable, secondary symbol representing an opposing team engages within the open mouth and the lower jaw is moved to create a chewing action, the interaction between the two symbols sending a message that the favored team will "chew up" or dominate the opposing team.

6 Claims, 1 Drawing Sheet

FIG. 1
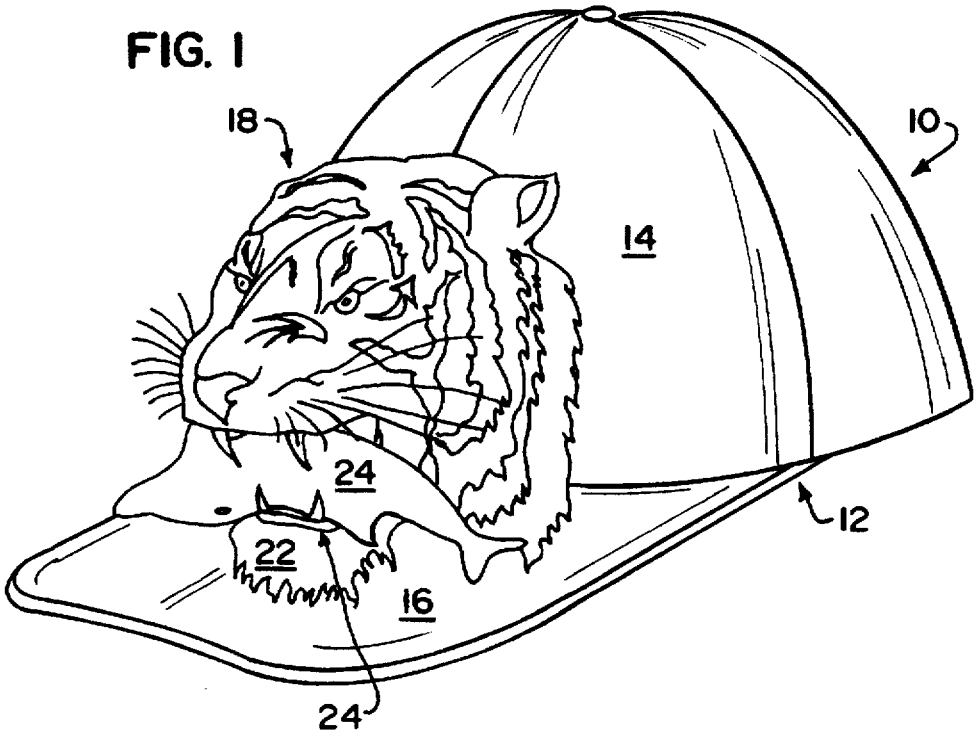
FIG. 3
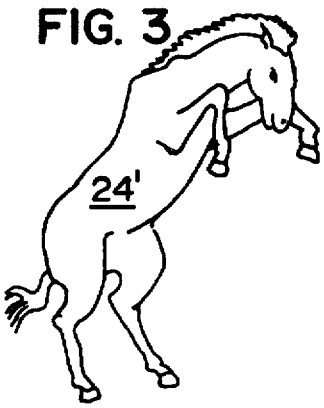
FIG. 2
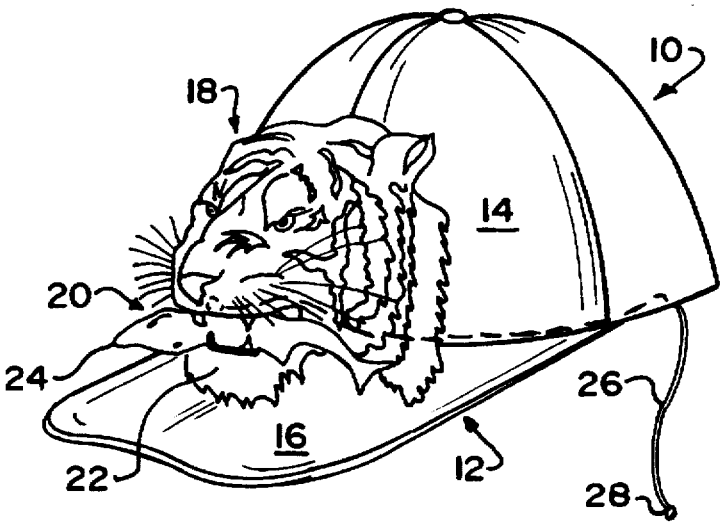
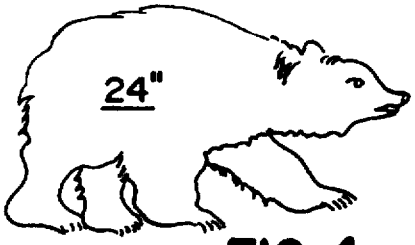
FIG. 4

SIMULATIVE SPORTS CAP KIT

BACKGROUND OF THE INVENTION

1. Field of the Invention

The present invention relates to a sports cap kit that includes a sports cap which incorporates on its visor a primary open mouth symbol of a favored team. A small version of each of any number of secondary opposing team symbols is also provided, the size of such secondary symbols being diminutive relative to the size of the primary symbol to allow for engagement of the secondary symbol with in the mouth of the primary symbol. An optional string may be provided to allow the wearer of the cap to move mouth structure of the primary symbol to show same "chewing up" the secondary symbol engaged within the open mouth, indicating a desired domination. The symbol duo may pertain to any desired teams, as well as to teams of any desired sport.

2. Prior Art

Heretofore, sports caps disclosed in the art provide any of several different themes on or above the visor thereof. Each theme, however, is typically represented by a solitary symbol. Also, sports caps incorporating movable symbols, such as a pair of clapable hands, have been proposed.

SUMMARY OF THE INVENTION

Accordingly, it is a primary object of the invention to provide a novelty sports cap kit which depicts an interaction between symbols of two competing teams with a primary team symbol shown in a position dominant to a secondary symbol of an opposing team, such position of dominance being produced by placing a smaller secondary symbol into the open mouth of the primary symbol. If desired, movement of the primary symbol's mouth may be produced to symbolize the favored team "chewing up" the opposing team.

BRIEF DESCRIPTION OF THE DRAWINGS

The present invention will be more thoroughly understood upon perusal of the detailed description thereof, and upon examination of the accompanying drawings, given as illustration only, in which:

FIG. 1 is a perspective view of a sports cap kit made in accordance with the teachings of the present invention, the kit including a sports cap incorporating a primary favored team symbol thereon, the symbol having an open mouth within which a secondary diminutive opposing team symbol is releasably secured.

FIG. 2 is a perspective view of the sports cap kit of FIG. 2, the cap here incorporating an optional pull string which is activated to produce motion of a jaw of the open mouth of the primary symbol about the secondary symbol secured therein.

FIG. 3 is a side view of a further secondary symbol embodiment.

FIG. 4 is a side view of yet a further secondary symbol embodiment.

DESCRIPTION OF THE PREFERRED EMBODIMENT

Referring now to the drawings in greater detail, there is illustrated therein a sports cap kit made in accordance with the teaching of the present invention and generally identified by the reference numeral 10. The kit 10 includes a sports cap 12 having a crown portion 14 and a visor 16. Extending forwardly from the crown portion 14 over and above the visor 16 is a symbol 18 which is representative of a particular favored sports team, hereinafter referred to as the primary symbol 18. This symbol 18 is provided with a mouth 20 which is created to have a normally open configuration. In the illustrative embodiment shown in the drawings, the primary symbol 18 is presented in the form of a large cat, or tiger 18. The mouth 20 of the tiger 18 is created in a manner producing a movable lower jaw 22, which allows for opening or closing of the mouth 20.

Engaged within the mouth 20 of the tiger 18 is a symbol 24 representative of an opposing team hereinafter referred to as the secondary symbol 24. In the illustrative embodiment, shown in FIGS. 1 and 2, the secondary symbol 24 is presented in the form of an aquatic life form, such as a dolphin 24. It will be seen that the secondary symbol 24 is significantly smaller than the primary symbol 18, and engages easily within the mouth 20 of the primary symbol 18 in a removable manner.

When the secondary symbol 24 is positioned within the mouth of the primary symbol 18 in the manner shown, the interaction sends a message that the favored team will "chew up", "eat up" or "kill" the opposing team.

If an enhancement of this message is desired, a pull string or cord 26 may be engaged to the lower jaw 22, and may extend outwardly of the crown portion 14 at any desired location for easy access.

Any suitable engagement of the string 26 to the lower 22 jaw may be created such that, upon pulling on a free end 28 of the string 26, the lower jaw 22 is caused to move upwardly, and moves downwardly when tension on the string 26 is released, with such sequential up and down jaw 22 action creating the appearance of the primary symbol 18 chewing the secondary symbol 24, indicating superiority of, or a desired dominance for, the favored team represented by the primary symbol 18.

It will be understood that a particular favored team may play against a plurality of opposing teams during a particular playing season. For this reason, the secondary symbol 24 must be removably engaged within the mouth 20 of the primary symbol 18. To produce a desired effect for each opposing team the favored team plays, the kit 10 may include a plurality of secondary symbols. For example, in FIG. 3 a secondary symbol 24 of a horse 24' is illustrated, such horse 24' being symbolic of itself as well as a colt, a stallion, a mare, etc., and in FIG. 4 a secondary symbol 24" of a bear 24" is illustrated, such bear being symbolic of itself, as well as a cub, etc.

The kit 10 then could either include a plurality of secondary symbol 24 representing every opposing team, or could be customized, providing only one or a selected grouping of opposing team symbols 24, as desired.

It will also be understood that the primary symbol 18 could take on any configuration symbolic of a favored team, with the symbol 18 being provided with a mouth 20 having a normally open configuration.

As described above, the sports cap kit 10 of the present invention provides a number of advantages, some of which have been described above and others which are inherent in the invention. Also, modifications may be proposed to the sports cap kit 10 without departing from the teachings therein. For example, although the primary symbol 18 is, in the preferred embodiment, a head 18 with open mouth 20 and movable jaw 22, an entire symbol 18, such as that of a rearing horse, could also be utilized, with the horse, for example, being movable to illustrate "stomping" the opposing team's symbol 24 which would be positioned subjacent thereto. Accordingly, the scope of the invention is only to be limited as necessitated by the accompanying claims.

I claim:

1. A sports cap kit consisting of a cap with a primary team symbol including a normally open mouth having a movable jaw thereon indicative of a favored sports team and at least one removable, diminutive secondary sports team symbol releasably engaged within the mouth of said primary symbol, the secondary sports team symbol being indicative of an opposing team, the symbols being interactive to generate a message of a desired dominance of the primary team symbolized.

2. The kit of claim 1 wherein a plurality of secondary symbols are provided.

3. The kit of claim 1 wherein said cap includes a crown portion and a visor.

4. The kit of claim 3 wherein the primary symbol extends outwardly of the crown portion over and above the visor.

5. The kit of claim 1 wherein said movable jaw is engaged by an actuator to cause jaw motion creating a closed mouth.

6. The kit of claim 5 wherein said actuator is a pull string.

* * * * *